US005377588A

United States Patent [19]

Fricke et al.

[11] Patent Number: 5,377,588

[45] Date of Patent: Jan. 3, 1995

[54] DELIVERY FOR A SHEET-FED PRINTING PRESS

[75] Inventors: Andreas Fricke, Eberbach; Udo Ganter, Friedberg, both of Germany

[73] Assignee: Heidelberger Druckmaschinen AG, Heidelberg, Germany

[21] Appl. No.: 165,979

[22] Filed: Dec. 13, 1993

[30] Foreign Application Priority Data

Dec. 11, 1992 [DE] Germany ..... 4241787

[51] Int. Cl.[6] ..... B41F 13/64

[52] U.S. Cl. ..... 101/240; 271/213; 271/218; 414/789; 414/790.8

[58] Field of Search ..... 101/232, 234, 235, 236, 101/237, 238, 239, 240, 241, 242; 271/213, 218; 414/789, 790.8

[56] References Cited

U.S. PATENT DOCUMENTS

| | | | |
|---|---|---|---|
| 4,511,301 | 4/1985 | Kawano et al. | 271/213 |
| 4,938,657 | 7/1990 | Benson et al. | 414/790.8 |
| 4,943,043 | 7/1990 | Huggins | 101/232 |
| 4,983,096 | 1/1991 | Bodewein | 414/790.8 |
| 5,005,822 | 4/1991 | Max et al. | 271/213 |
| 5,088,405 | 2/1992 | Sugimoto et al. | 101/240 |
| 5,092,236 | 3/1992 | Prim et al. | 271/213 |
| 5,110,112 | 5/1992 | Henn et al. | 271/218 |
| 5,284,089 | 2/1994 | Buck et al. | 101/232 |

FOREIGN PATENT DOCUMENTS

| | | |
|---|---|---|
| 1116238 | 11/1961 | Germany . |
| 2301840 | 7/1974 | Germany . |
| 3046107 | 6/1982 | Germany . |
| 3023533 | 11/1982 | Germany . |
| 8337805 | 11/1986 | Germany . |
| 3836571 | 1/1991 | Germany . |
| 1461692 | 1/1977 | United Kingdom . |
| 2078687 | 1/1982 | United Kingdom . |
| 2092113 | 8/1982 | United Kingdom . |

*Primary Examiner*—Eugene H. Eickholt

*Attorney, Agent, or Firm*—Herbert L. Lerner; Laurence A. Greenberg

[57] ABSTRACT

Delivery for a sheet-fed printing press includes a device for conveying sheets supplied from the printing press in a given conveying direction to a location at which the sheets fall consecutively onto a pile of the sheets, a swivelingly mounted stop shaft carrying retractable stops for leading edges of the sheets in an upper region of the sheet pile, a swivelingly mounted catching-arm shaft disposed adjacent to the stop shaft and carrying a plurality of lever arms, respective catching arms articulatedly connected to the lever arms, the catching arms being insertable in a direction opposite to the conveying direction between the falling sheets for catching and auxiliarly supporting the sheets, a drive member swivelable about a rotary axis, and connecting members for connecting both the retractable stops and the catching arms in common to the drive member for performing an enforced sequence of movements of the catching arms and the stops wherein the stops are retracted following an insertion of the catching arms between the falling sheets, and the catching arms are withdrawn following a return of the stops to a stop position, the connecting members being respective complementary mating members disposed on the drive member, on one hand, and on the stop shaft and the catching-arm shaft, on the other hand, the connecting members on the drive member being offset by a phase angle from one another causing the enforced sequence of movements of the catching arms and the stops.

12 Claims, 9 Drawing Sheets

DELIVERY FOR A SHEET-FED PRINTING PRESS

SPECIFICATION

The invention relates to a delivery for a sheet-fed printing press and, more particularly, to such a delivery having movable catching arms and stops for leading edges of sheets deposited on a sheet pile.

As has become known heretofore from published German Patent Document 38 36 571 C2, for the purpose of sheet removal while the printing press is running, a conventional delivery is provided with a lever mechanism for moving catching arms from a withdrawn basic position into an extended catching position and, conversely, also for retracting stops for a leading edge of sheets from a stop position of the stops at a sheet pile and for re-extending the stops before the catching arms can be withdrawn. To this end, the lever mechanism comprises a driving element formed of a sliding block or sliding pin drive swivelable by an actuating lever, an end-position spring, swivelable with respect to a swivel axis, being articulatedly connected to the sliding pin drive. With the lever mechanism in a first end position, the end-position spring holds the catching arms in the withdrawn basic position in opposition to the action of at least one tension spring and, with the lever mechanism in a second end position, the end-position spring holds the stops in a release position in opposition to the action of the stop spring. A first articulated connection, with the first lost motion, between the sliding pin drive and a rocker arm for moving the catching arms into the catching position and into the basic position is formed of a first link, which is articulatedly connected, at one end thereof, to the rocker arm and, at the other end thereof, to a crank pin of the sliding pin drive in such a manner that the crank pin is displaceable over a defined distance in the longitudinal direction of the first link with respect thereto. A second articulated connection, with the second lost motion, of the sliding pin drive to a stop lever for flapping the stops into the release position and into the stop position is formed of a second link, which is articulatedly connected, at one end thereof, to the crank pin of the sliding pin drive and, at the other end thereof, to a driving pin of the stop lever in such a manner that the driving pin is displaceable over a defined distance in the longitudinal direction of the second link with respect thereto. In both end positions, the lever mechanism is subjected to a loading by the aforementioned springs.

It is accordingly an object of the invention to provide a delivery of the foregoing general type wherein components for forced consecutive movement of the catching arms and the stops, which permit sheet removal during the operation of the printing press, are simplified, and wherein the components are accommodated in a smaller space than heretofore.

With the foregoing and other objects in view, there is provided, in accordance with the invention, a delivery for a sheet-fed printing press, comprising means for conveying sheets supplied from the printing press in a given conveying direction to a location at which the sheets fall consecutively onto a pile of the sheets, a swivelingly mounted stop shaft carrying retractable stops for leading edges of the sheets in an upper region of the sheet pile, a swivelingly mounted catching-arm shaft disposed adjacent to the stop shaft and carrying a plurality of lever arms, respective catching arms articulatedly connected to the lever arms, the catching arms being insertable in a direction opposite to the conveying direction between the falling sheets for catching and auxiliarly supporting the sheets, drive means swivelable about a rotary axis, and connecting means for connecting both the retractable stops and the catching arms in common to the drive means for performing an enforced sequence of movements of the catching arms and the stops wherein the stops are retracted following an insertion of the catching arms between the falling sheets, and the catching arms are withdrawn following a return of the stops to a stop position, the connecting means comprising respective complementary, mating connecting members disposed on the drive means, on one hand, and on the stop shaft and the catching-arm shaft, on the other hand, the connecting members on the drive means being offset by a phase angle from one another causing the enforced sequence of movements of the catching arms and the stops.

These structural features considerably reduce the number of components required in order to obtain an enforced sequence of movements of the catching arms and the stops during the insertion of the catching arms and the stops, respectively, and a sequence of movements of the catching arms during the withdrawal thereof. Moreover, less space is required for this reduced number of components. A further considerable advantage is that the required components are reduced in size compared to those of the prior art, so that they are of lighter weight.

In accordance with another feature of the invention, the drive means comprise a rotatably mounted ring, and the connecting members comprise intermeshing toothed elements.

In accordance with a further feature of the invention, the connecting members disposed on the drive means comprise two arcuate toothed sections having the same tooth-pitch diameter, and the connecting members disposed on the stop shaft and on the catching-arm shaft are formed as respective toothed segments each consecutively meshable with one of the two toothed sections.

In accordance with an added feature of the invention, the drive means comprise a rotatably mounted ring, and the toothed sections are disposed thereon, and a first tooth of the toothed section meshable with the toothed segment of the stop shaft, and a last tooth of the toothed section meshable with the toothed segment of the catching-arm shaft are offset in circumferential direction of the ring with respect to one another by a given angle, due to which the first tooth engages the toothed segment of the stop shaft only when the toothed segment of the catching-arm shaft has released the last tooth.

In accordance with an additional feature of the invention, the drive means comprise a ring rotatably mounted in a frame of the printing press, and the two toothed sections are formed on the inside of the ring.

In accordance with yet another feature of the invention, the stop shaft and the catching-arm shaft are closely juxtaposed at substantially the same height and parallel to one another.

In accordance with yet a further feature of the invention, the toothed segments, respectively on the stop shaft and on the catching-arm shaft, and the ring with the two toothed sections formed on the inside thereof are disposed on each of the two sides of the printing press.

In accordance with yet an added feature of the invention, both of the toothed segments and the respective toothed sections have slightly overlapping angles of mesh, so that at least one tooth-flank contact is maintained in each of the toothed segments of each of the pairs of meshing toothed sections and toothed segments.

In accordance with yet an additional feature of the invention, the teeth of the toothed segment on the catching-arm shaft are in meshing engagement with the appertaining toothed section of the ring, when the catching arm is in a rest position, and the teeth of the toothed segment on the stop shaft are in engagement with the appertaining toothed section of the ring, when the stops are in a retracted position.

In accordance with another feature of the invention, the delivery includes respective end-position springs anchored to a frame of the printing press and connected to the stop shaft and the catching-arm shaft, the end-position springs being arranged so as to attain a maximum tensioning force on a swiveling path of the respective shaft connected thereto from one end position to another end position thereof.

In accordance with a further feature of the invention, the drive means comprise a rotatable ring, and the complementary, mating connecting members on the ring are formed as sliding-block guides open at one side thereof, and the complementary, mating connecting members of the catching-arm shaft and the stop shaft are formed as respective pins fixedly connected to respective levers attached to the catching-arm shaft and the stop shaft.

In accordance with a concomitant feature of the invention, the drive means comprise a rotatable ring carrying a sliding-block guide, and a linearly movably-guided member engaging in the sliding-block guide for converting linear motion of the member into rotational motion of the ring.

Thus, the drive means comprise a rotatably mounted ring, the rotational motion of which can be transmitted by intermeshing connecting members, comprising gear teeth or the like, to the catching-arm shaft and to the stop shaft in the desired enforced sequence of movements. In the simplest form thereof, the connecting members are made up of sliding-block guides open at one end thereof and disposed in the ring serving as the drive means, and complementary mating members comprising pins, each of which is fixedly connected to a lever on the catching-arm shaft and to a lever on the stop shaft, respectively.

A somewhat more convenient embodiment of the invention results from a respective toothed segment being disposed on the catching-arm shaft and the stop shaft, the toothed segments, respectively, consecutively engaging one of two toothed sections formed with the same tooth-pitch diameter on the rotatably held ring. The toothed segments on the ring-shaped driving element are angularly offset in such a manner that the toothed segment on the stop shaft can only mesh with the associated toothed section on the driving element when the catching arms have reached the inserted positions thereof.

In the special construction of the invention wherein a ring serving as the drive means is disposed on both of the printing-press sides, and the angles of mesh for both toothed segments with the respective toothed sections on the ring are slightly overlapping, there is always a force-locking connection between the two rings, respectively disposed on both printing-press sides. In this regard, it is noted that a force-locking connection is one which connects two elements together by force external to the elements, as opposed to a form-locking connection which is provided by the shapes of the elements themselves.

Other features which are considered as characteristic for the invention are set forth in the appended claims.

Although the invention is illustrated and described herein as embodied in a delivery of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
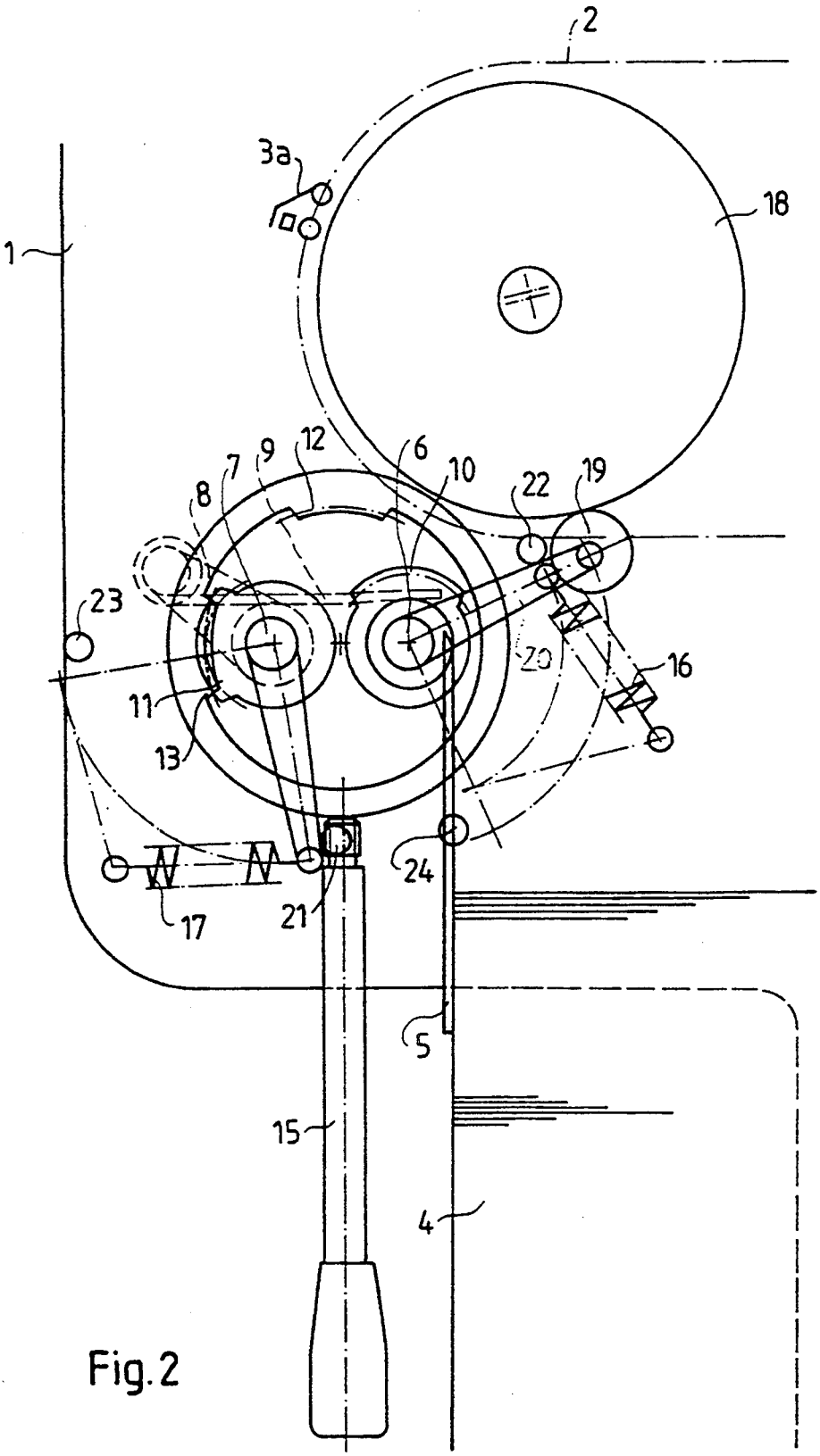
FIG. 2 is an enlarged fragmentary side elevational view of FIG. 1, showing a drive for moving catch arms and stops in a zero position or first stop position thereof.
Figure 3:
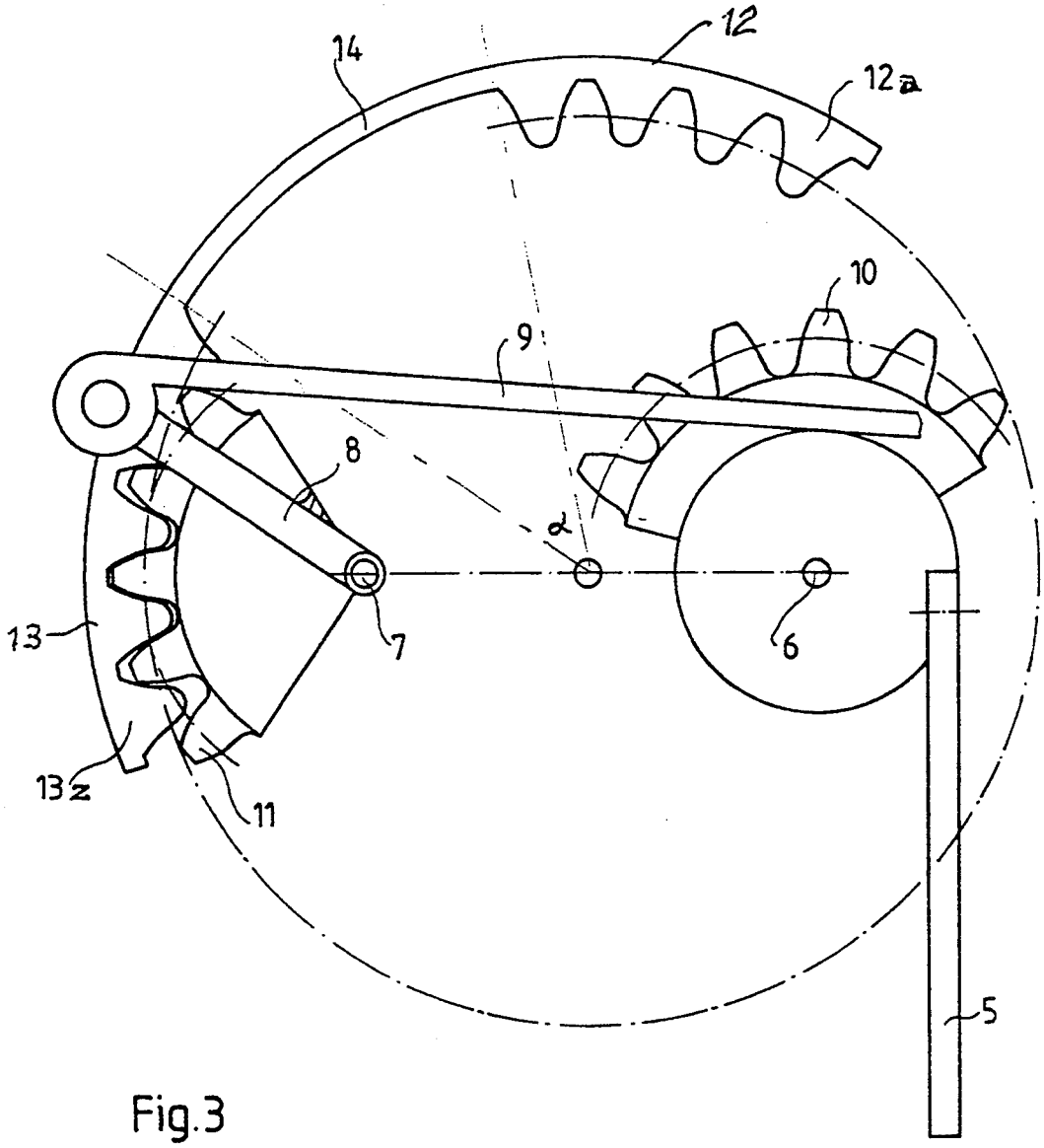
FIG. 3 is an enlarged fragmentary view of FIG. 2, showing how the teeth are meshed in the stop position of the drive in the latter figure.
Figure 5:
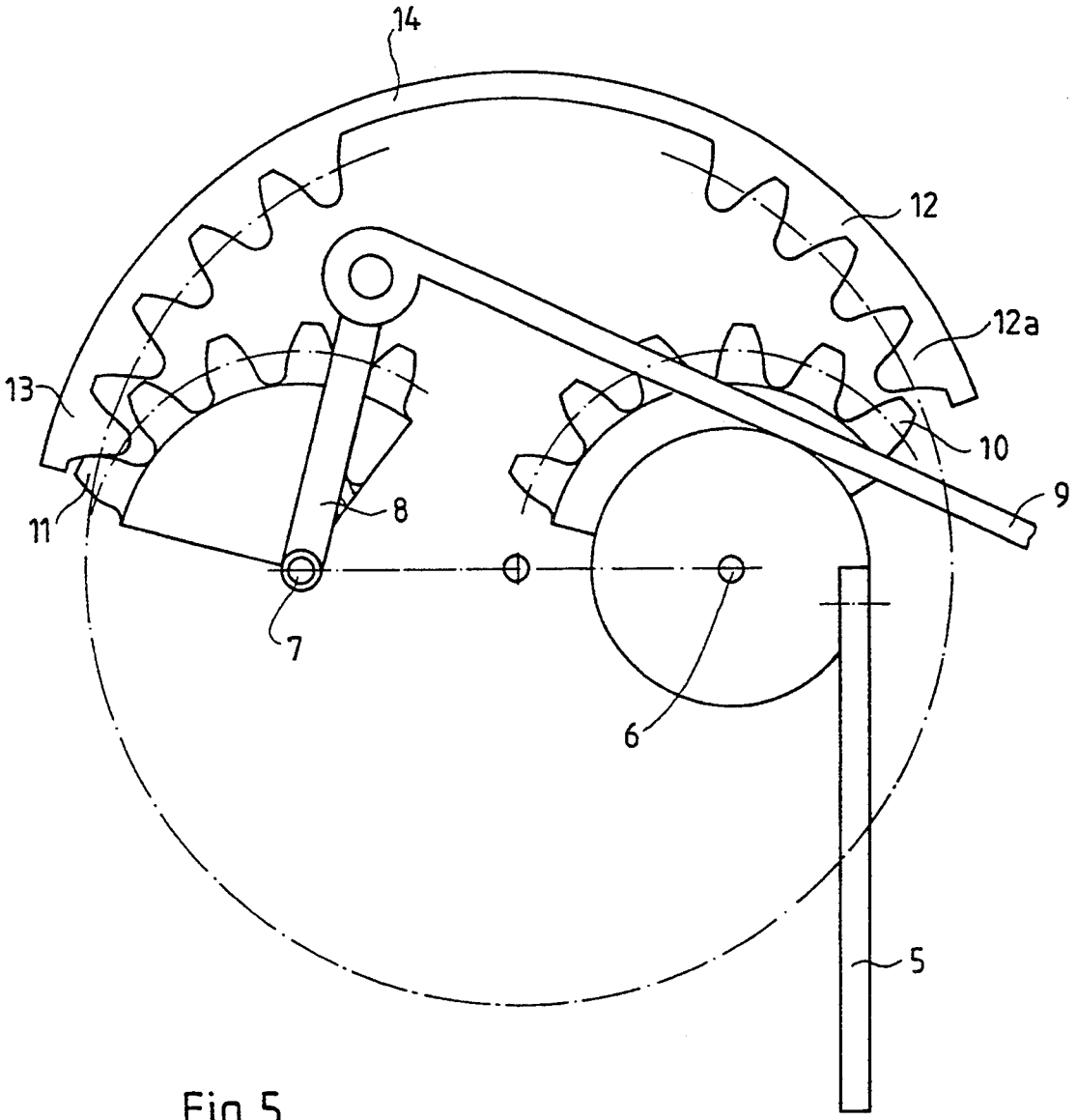
FIG. 5 is an enlarged fragmentary view of FIG. 4, showing how the teeth are meshed in the intermediate position of the drive in the latter figure.
Figure 7:
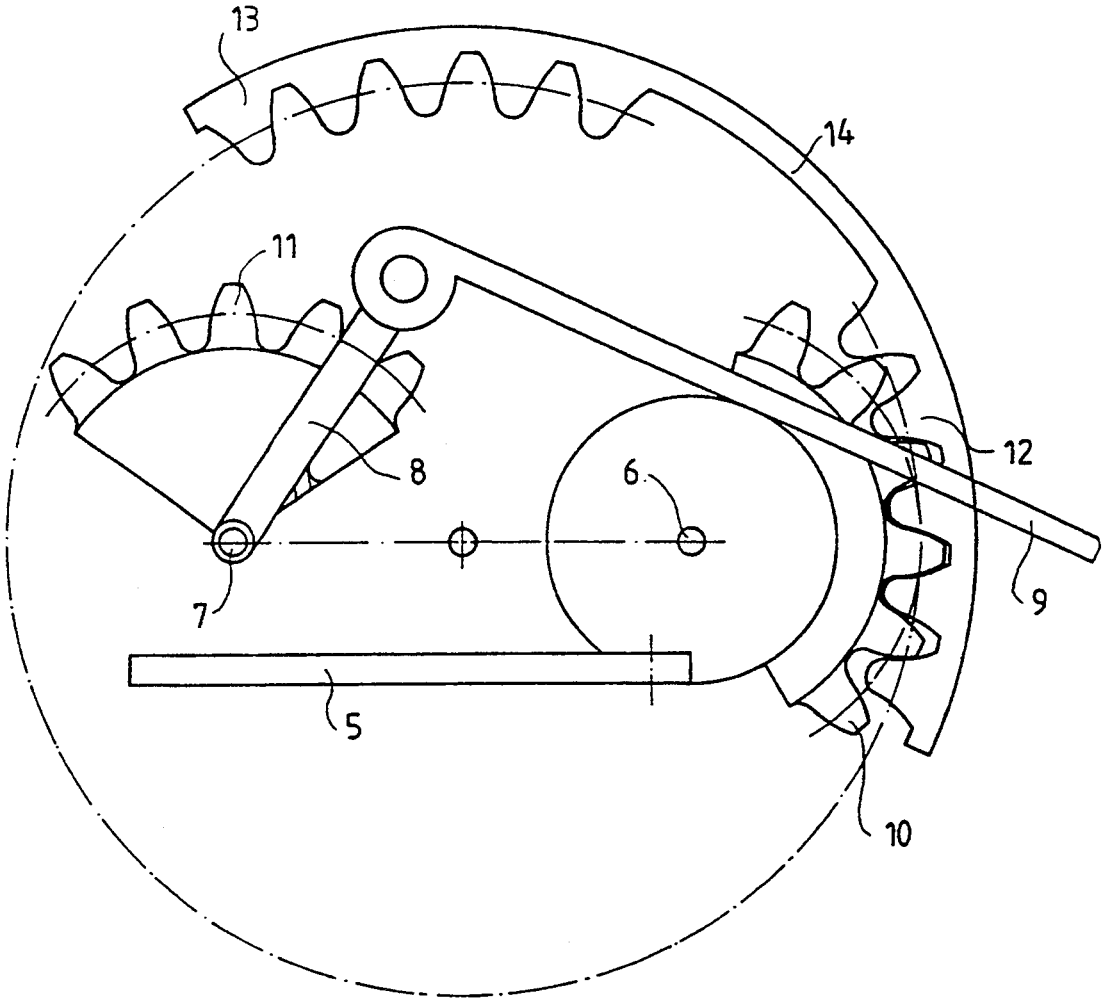
FIG. 7 is a view like that of FIGS. 3 and 5, showing how the teeth are meshed in the other end position.
Figure 8:
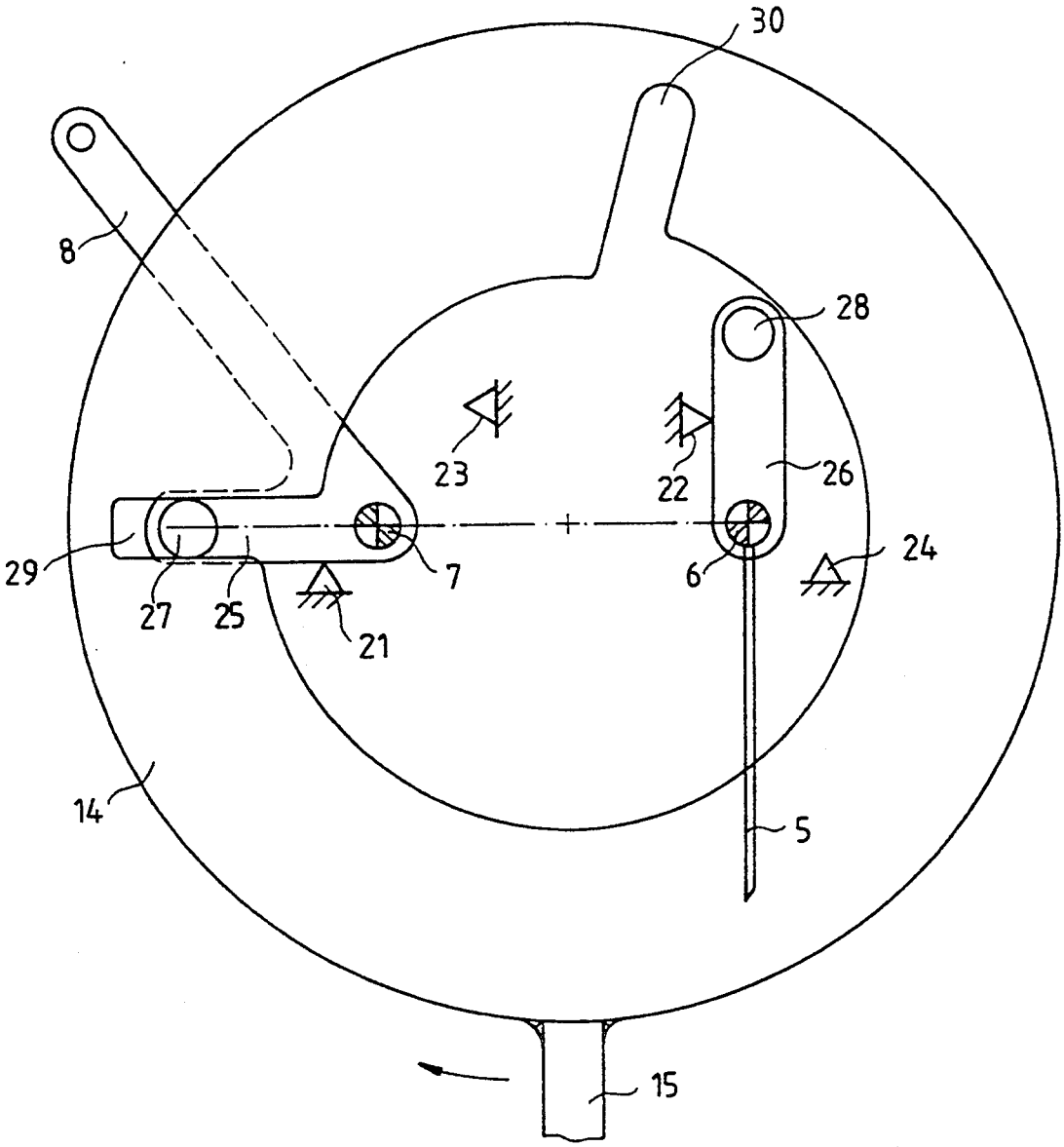
Figure 9:
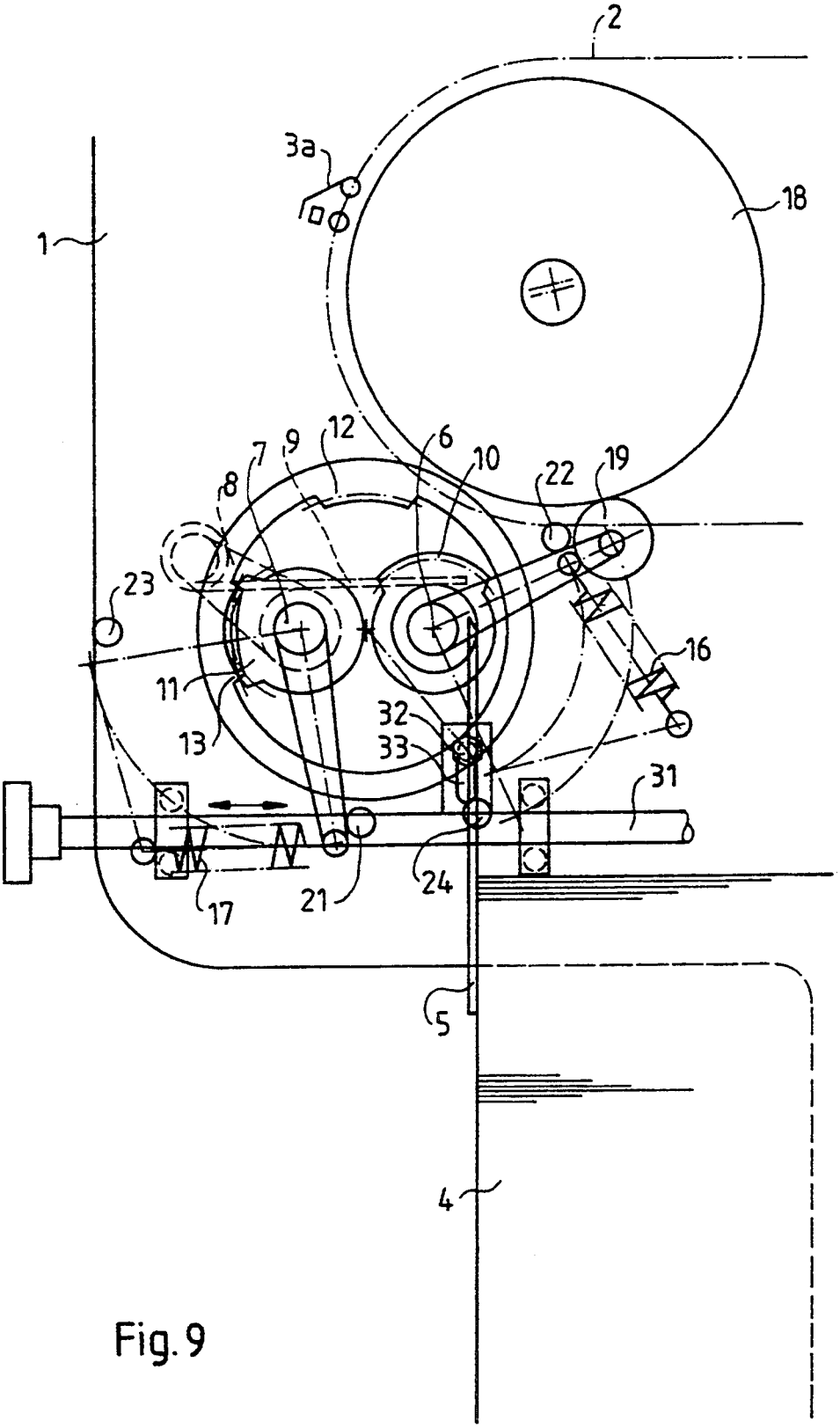

FIG. 8 is a view similar to that of FIGS. 3, 5 and 7 and approximately on the scale thereof of another embodiment of the invention wherein the drive has connecting members which differ in construction from those in the embodiment of FIGS. 3, 5 and 7; and FIG. 9 is a view similar to that of FIG. 2 of a further embodiment of the invention differing in the means for actuating the drive member thereof.

Figure 1:
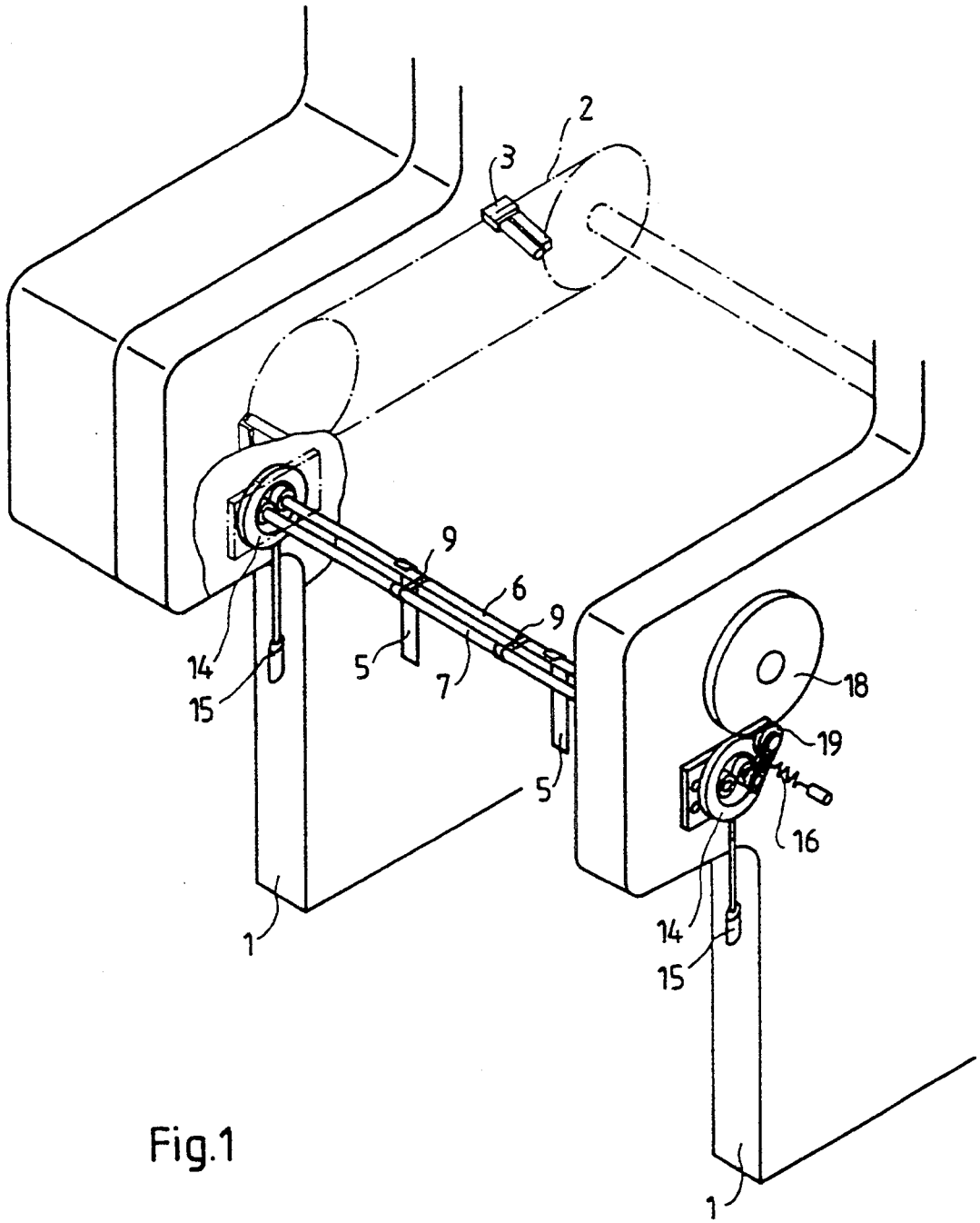
FIG. 1 is a top, rear and side perspective view of a delivery of a printing press constructed in accordance with the invention.

Referring now to the drawings and, first, particularly to FIGS. 1 and 2 thereof, there is shown therein, a delivery for a sheet-fed rotary printing press provided with the features according to the invention. Thus, supported on a frame 1 of a printing press, are conveying means formed of revolving chains 2 which carry gripper bars 3 extending transversely to the conveying direction, sheet grippers 3*a* being attached to the gripper bars 3 and being controllably movable in accordance with the operating cycle of the printing press. Sheets released by the sheet grippers 3*a* carried by the gripper bars 3 in the delivery above a sheet pile 4 fall onto the sheet pile 4 under their own weight and as a result of inertial forces aided by other measures in the delivery, the sheets having respective leading edges abutting vertically disposed stops 5 and, if necessary or desirable, being disposed between non-illustrated side stops. A plurality of the stops 5 are distributed across the width of the sheet pile 4 and are attached to a stop shaft 6 extending transversely to the conveying direction of the sheets, the stop shaft 6 being journalled at the ends thereof in the printing-press frame 1 and being swivelable about the longitudinal axis thereof. Parallel to and closely juxtaposed with the stop shaft 6 is a catching-arm shaft 7, likewise journalled at the ends thereof, so as to be swivelable about the longitudinal axis thereof, in the printing-press frame 1. Attached to the catching-arm shaft 7 are catching-arm levers 8 having free ends which are articulatedly connected to catching arms 9 and to conventional guiding means by which the catching arms 9 are guided on a predetermined travel path when the catching-arm shaft 7 is swiveled. A toothed segment 10 is attached to the stop shaft 6 on one side or, advantageously, both on the drive side as well as on the operating side, and another toothed segment 11 is likewise fixedly mounted on the catching-arm shaft 7, each of the toothed segments 10 and 11 being associated with respective matching toothed sections 12 and 3 formed on an inner circumference of a ring 14 mounted in the printing-press frame, the toothed sections 12 and 13 having a common tooth-pitch circle. The two toothed sections 12 and 13 are offset from one another in the circumferential direction by an angle $\alpha$, so that when the ring 14 is rotated in a clockwise direction, the first tooth 12*a* (FIG. 3) of the toothed section 12 can engage in the toothed segment 10 on the stop shaft 6 when the last tooth 13*z* (FIG. 3) of the toothed section 13 is no longer in engagement with the toothed segment 11 on the catching-arm shaft 7. Torque transmission by intermeshing sets of teeth affords a suitable transmission ratio, so that, with a relatively short drive path or travel distance, it is possible to attain relatively large swivel angles both for the stop shaft 6, as well as for the catching-arm shaft 7. The turning of the ring 14 in one or the other rotary direction may be accomplished manually, for example by a hand lever 15 fixedly connected to the ring 14 or, where necessary or desirable, by means of a motorized drive. Due to the aforementioned transmission ratio, it is possible to achieve a considerably higher swiveling angle of the two shafts 6 and 7, for example, by turning each of the hand levers through an angle of 45°.

Figure 4:
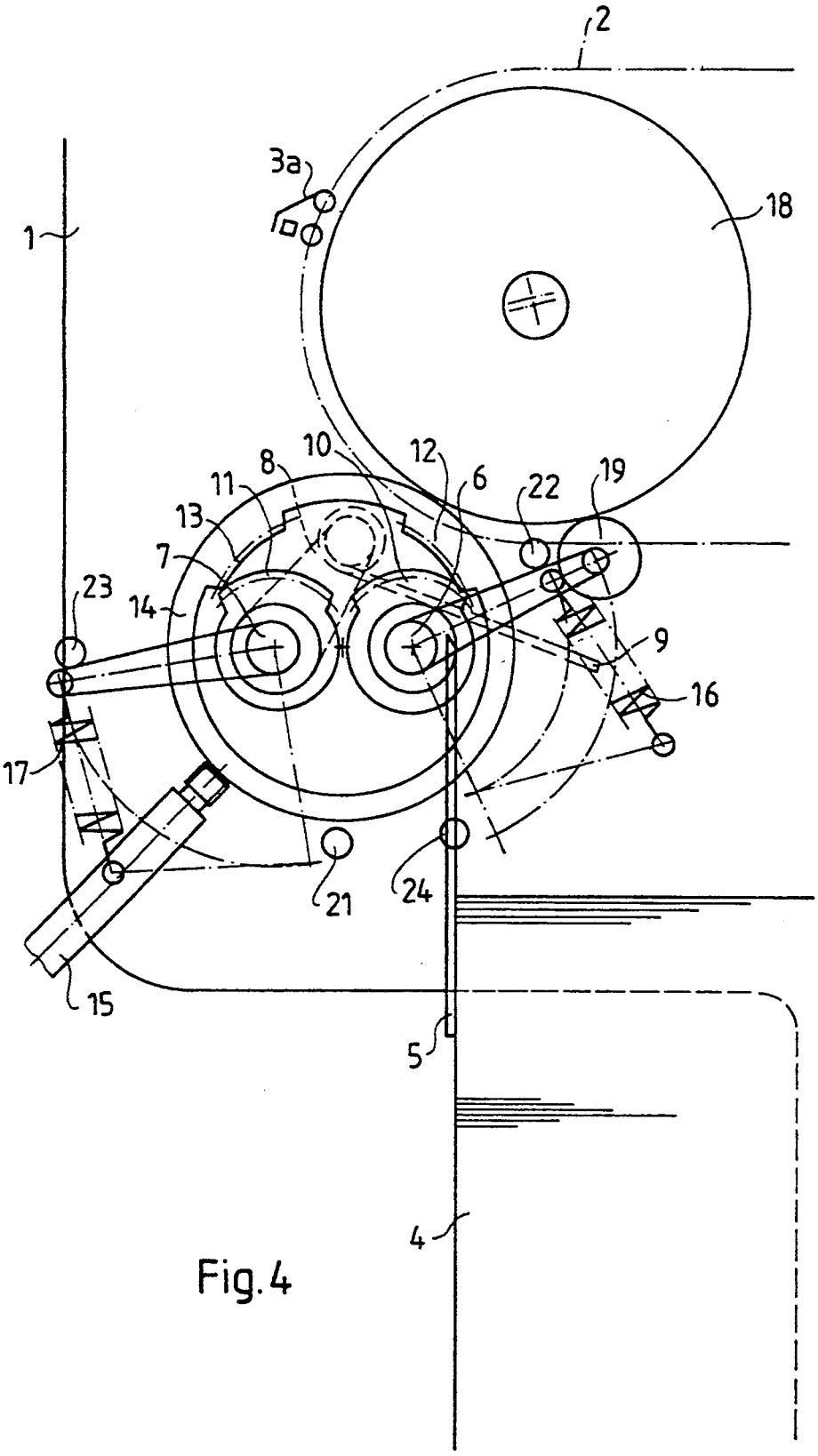
FIG. 4 is a view like that of FIG. 2 in another functional phase of the delivery wherein the drive is in an intermediate position thereof.
Figure 6:
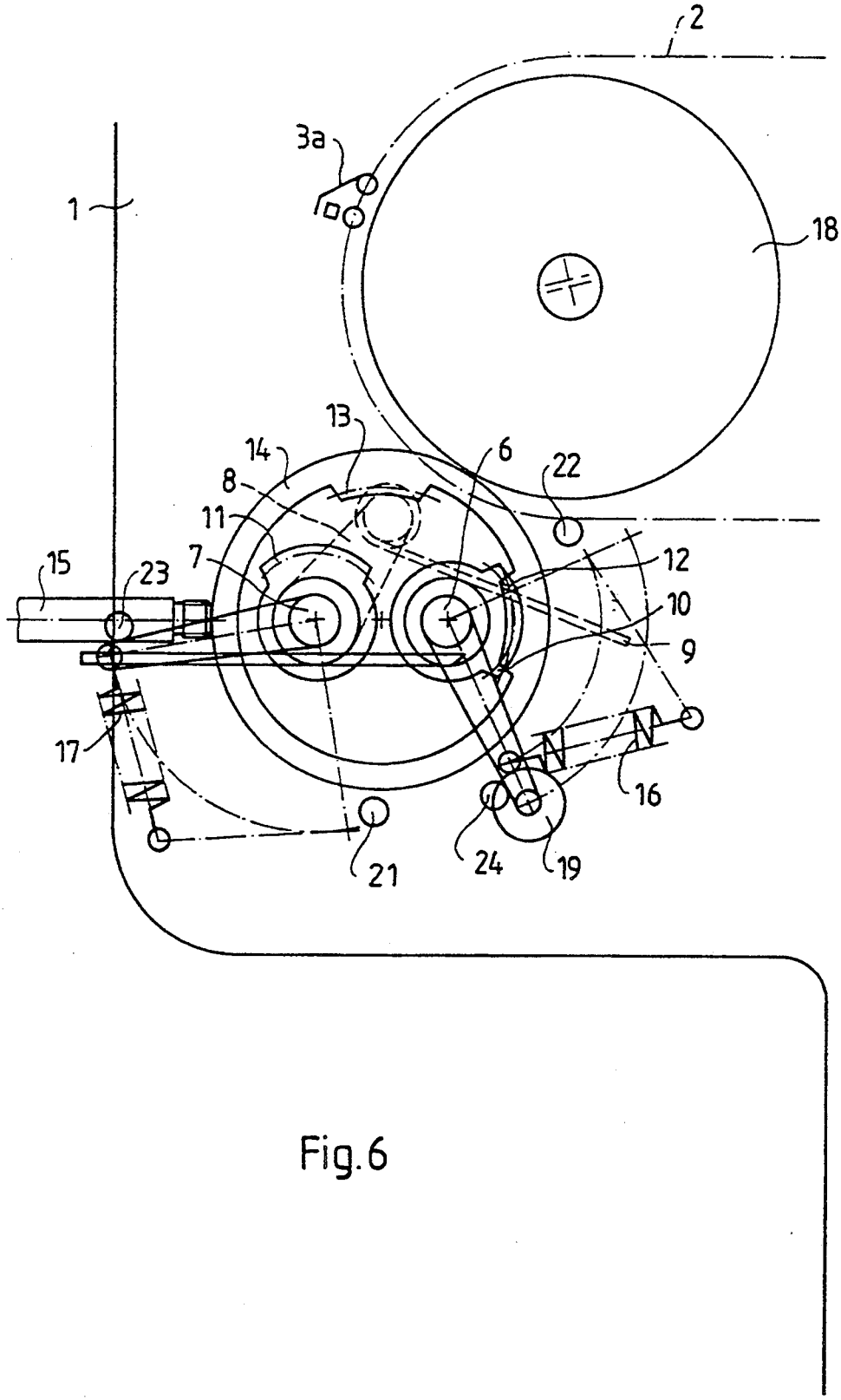
FIG. 6 is a view like that of FIG. 2 and FIG. 4 in a further functional phase of the delivery, namely, in the operating or second stop position.

Means for permitting the removal of inspection or proof sheets are subjected to a loading in both end positions by conventional end-position springs 16 and 17, which are articulatedly attached respectively, at one end thereof, to the printing-press frame and, at the other end thereof, to lever arms on the stop shaft 6 and the catching-arm shaft 7, respectively, so that they achieve their maximum tensioning force when the respective ring 14 is moved from one end position into the other end position. The two end positions are shown in FIGS. 2 and 4, whereas an intermediate position is shown in FIGS. 3 and 4, respectively. In the end position shown in FIG. 2, the stops 5 are in the vertical position thereof, so that the lower ends thereof lie flatly against or flush with the front side of the pile of sheets 4, i.e., the side thereof at which the respective front or leading edge of the sheets thereof is located. In this position, the toothed segment 10 is out of meshing engagement with the appertaining toothed section 12, so that the movements of a cam disc 18 of a conventional straight-jogging device can be transmitted to a roller 19 rotatably mounted on a lever arm 20 which is secured to the stop shaft 6, without simultaneously having any effect upon the ring 14 or consequently upon the catching-arm shaft 7. In this end position, the catching arms 9 are in a withdrawn rest position in which the teeth of the toothed segment 11 on the catching-arm shaft 7 are in meshing engagement with the toothed section 13 on the ring 14. When the hand lever 15 is swiveled in a clockwise direction, as viewed in FIG. 2, for example, initially only a swiveling of the catching-arm shaft 7 in the same direction occurs because the teeth of the toothed segment 10 and of the toothed section 12 are out of meshing engagement. Thereby, first of all, the catching arms 9 are shifted into a catching position, as shown in FIGS. 4 and 5, respectively, so that they are inserted between falling sheets, and an auxiliary sheet pile can thus be formed on the catching arms 9. Only when the hand lever 15 is further swiveled in the clockwise direction into the position shown in FIGS. 6 and 7, respectively, does the movement of the catching arms 9 cease, and only a swiveling of the stops 5 occurs about the axis of the stop shaft 6 out of the stop position shown in FIG. 2 and into the horizontal position shown in FIG. 6, so that it is then possible to remove inspection sheets from below the auxiliary pile forming on the catching arms 9. The end positions both of the stop shaft 6, as well as of the catching-arm shaft 7 are fixed by stops 22, 24 and 23, 21, respectively, so that both the stop shaft 6 and the catching-arm shaft 7 are held in their stop positions by the end-position springs 16 and 17, respectively. The necessarily consecutive movements of the stop shaft 6 and the catching-arm shaft 7 are performed in a manner that, when the hand lever 15 is swiveled out of the position shown in FIG. 2, meshing engagement of the first tooth 12*a* of the toothed section 12 with the toothed segment 10 on the stop shaft 6 cannot take place until the last tooth 13*z* of the toothed section 13 is out of meshing engagement with the toothed segment 11 on the catch-arm shaft 7. Accordingly, the first tooth of the toothed section 12 and the last tooth of the toothed section 13 are offset in the circumferential direction by the angle $\alpha$. When the hand lever 15 is swiveled in a counter-clockwise direction, initially the toothed segment 10 rolls-off in the toothed section 12, so that the stops 5 are swiveled back into the position thereof shown in FIG. 2. Only thereafter do the teeth of the toothed segment 11 on the catching-arm shaft 7 meshingly engage with the toothed section 13, so that the catching arms 9 are withdrawn into the position thereof shown in FIG. 2, and the auxiliary pile deposited on the catching arms 9 drops or sinks onto the main sheet pile 4.

In order to ensure a clean positive movement of the catching arms 9 and the stops 5, it is a common practice to firmly connect an actuating element on the operating side and a corresponding actuating element on the drive side to one another by means of a through-shaft. In the construction according to the invention, it is possible to dispense with such a through-shaft, so that the rings 14, respectively on the operating side and on the drive side are not directly connected to one another. In order, however, to ensure that both rings 14 move in synchronism with one another under the action of the respective springs 16 and 17, notwithstanding that only one ring 14 on one printing-press side is driven by the hand lever 15, it is necessary for the alternately intermeshing mating teeth 10 and 12, on the one hand, and 11 and 13, on the other hand, to be in meshing engagement jointly over a given driving-angle interval of the ring 14 on both printing-press sides.

According to a special construction of the invention, this is achieved by providing that the angles of action or mesh of both toothed segments 10 and 11 with the toothed sections 12 and 13 slightly overlap, so that at least one tooth-flank contact of both the toothed segment 10 in the toothed section 12, as well as the toothed segment 11 in the toothed section 13, is maintained. The non-driven ring is thereby prevented from moving uncontrollingly. The temporary overlap of teeth meshing engagement for the movement of the catching arm 9 and of teeth meshing engagement for the movement of the stop 5 occurs only over a small rotary angle, for example 10°, as a result of which the effectiveness of the device according to the invention is not restricted.

For this constructive arrangement, therefore, the following mode of operation results. On one printing-press side, the ring 14 is moved in a clockwise direction by the hand lever 15. Through the intermediary of the mating teeth 11 and 13 on the printing-press side, the motion is transmitted to the catching-arm shaft 7. The toothed segment 11 on the other printing-press side, likewise fixedly connected to the catching-arm shaft 7, moves the ring 14 on that other printing-press side in synchronism with the ring 14 on the one printing-press side. Initially, the end-position spring 17 produces a torque acting counter-clockwise at the toothed segment 11, the torque being absorbed by the toothed section 13. When the hand lever 15 is swiveled farther, the torque at the toothed segment 11 reverses, so that a change of flank contact between the toothed elements 11 and 13 occurs. Due to the spring action, the catching-arm lever 8 moves into its inserted (right-hand) end position, and entrains the ring 14. Both of the printing-press sides, however, are force-lockingly connected to one another due to the slight overlap of the toothed segments 10 and 11, respectively, with the toothed sections 12 and 13, respectively. In this regard, it is noted that a force-locking connection is one which connects two elements together by force external to the elements, as opposed to a form-locking connection which is provided by the shapes of the elements themselves.

It is apparent from FIG. 5 that the mating teeth 11 and 13 on both printing-press sides are released only when the tooth 12*a* has been meshingly enclosed by two teeth flanks of the toothed segment 10. Then, the ring 14, as the last link in the kinematic chain, is also forcedly moved in synchronism with the ring 14 on the other printing-press side because, due to a symmetrical arrangement, the tooth 12 on the opposite printing-press side is also guided by two teeth flanks of the toothed segment 10. It is therefore necessary for a hand lever 15 to be provided on only one printing-press side for the purpose of actuating the drive element on that printing-press side. The drive element on the other printing-press side is thus forcedly entrained and driven along therewith. Consequently, stops 21 to 24 for securing the end positions are also required only on one printing-press side. The end-position spring 16 exerts an additional counterclockwise torque on the ring 14 through the intermediary of the toothed segment 10. During further swiveling, the toothed elements 11 and 13 at both of the printing-press sides come out of meshing engagement. The swiveling of the stops 5 is achieved by the ring 14 through the intermediary of the mating teeth 10 and 12. In this regard, the rings 14 on both printing-press sides move in synchronism. When both of the always mutually force-lockingly connected rings 14 on the two printing-press sides are moved back, an analogous process is repeated, although only one ring 14 on one printing-press side is being driven.

FIG. 8 shows a construction of the device according to the invention which is of lower cost and is considerably simpler than the hereinaforedescribed device. In this arrangement, a lever arm 25 is attached to the catching-arm shaft 7, and a lever arm 26 is attached to the stop shaft 6. Located at the free ends of the lever arms 25 and 26 are pins or bolts 27 and 28, respectively, serving as complementary connecting members to coulisses or sliding-block guides 29 and 30, which are formed in the ring 14. The two sliding-block guides 29 and 30 formed in the ring 14 are offset in phase with respect to one another, in accordance with the foregoing description. The flanks of the sliding-block guides 29 and 30 are of such construction that the contact between the respective pin 27 or 28 and the appertaining sliding-block guide 29 or 30 takes place and ceases at the desired instant of time. In order to obtain enforced sequences of movement of the respectively non-driven ring 14, both on the drive side, as well as on the operating side, analogous to the aforedescribed constructions with the gear teeth, the pins 27 and 28 on the lever arms 25 and 26, respectively, must be enclosed by both flanks of the corresponding sliding block guide 29 and 30, respectively, over a given driving-angle interval of the rings 14. In this arrangement, the stops 21 and 23, on the one hand, and 22 and 24, on the other hand, taken in conjunction with the end-position springs 16 and 17, have the same function as was already described hereinbefore.

Because the catching-arm shaft 7 and the stop shaft 6 mutually support one another in their end positions through the intermediary of the transmission, it would also be necessary only to have one stop on each printing-press side for end-position supporting of the system. Furthermore, also with only an arrangement of the stops 5 on one side of the printing press for end-position fixing in the embodiment of the invention shown in FIGS. 1, 2 and 4, it is possible to dispense with the stop 22 because, in the end position shown in FIGS. 1, 2 and 4, the stop shaft 6 is braced against the disc 18 by the roller 19.

As shown in FIG. 9, a further embodiment of the invention calls for replacing the hand lever for moving the ring 14, which acts as the drive element, by a linearly movable member 31. The member 31 and the ring 14 engage with a sliding-block guide formed of a pin 32, for example, on the ring 14 and a sliding block 33 on the member 31, so that a linear driving movement, for example, of a pneumatic cylinder, toothed rack or the like, is converted into a rotary movement of the ring 14. This leads conceptually to a further possible embodiment of the invention, wherein the ring 14 is formed with an infinitely large radius, so that an oscillatingly movable drive element with toothed sections is produced, having an arrangement and construction corresponding to those of the aforedescribed toothed segments 10 and 11 (FIGS. 1 to 7).

We claim:

1. Delivery for a sheet-fed printing press, comprising means for conveying sheets supplied from the printing press in a given conveying direction to a location at which the sheets fall consecutively onto a pile of the sheets, a swivelingly mounted stop shaft carrying retractable stops for leading edges of the sheets in an upper region of the sheet pile, a swivelingly mounted catching-arm shaft disposed adjacent to said stop shaft and carrying a plurality of lever arms, respective catching arms articulatedly connected to said lever arms, said catching arms being insertable in a direction opposite to the conveying direction between the falling sheets for catching and auxiliarly supporting the sheets, drive means swivelable about a rotary axis, and connecting means for connecting both said retractable stops and said catching arms in common to said drive means for performing an enforced sequence of movements of said catching arms and said stops wherein said stops are retracted following an insertion of said catching arms between the falling sheets, and said catching arms are withdrawn following a return of said stops to a stop position, said connecting means comprising respective complementary, mating connecting members disposed on said drive means, on one hand, and on said stop shaft and said catching-arm shaft, on the other hand, said connecting members on said drive means being offset by a phase angle from one another causing said enforced sequence of movements of said catching arms and said stops.

2. Delivery according to claim 1, wherein said drive means comprise a rotatably mounted ring, and said connecting members comprise intermeshing toothed elements.

3. Delivery according to claim 1, wherein said connecting members disposed on said drive means comprise two arcuate toothed sections having the same tooth-pitch diameter, and said connecting members disposed on said stop shaft and on said catching-arm shaft are formed as respective toothed segments each consecutively meshable with one of said two toothed sections.

4. Delivery according to claim 3, wherein said drive means comprise a rotatably mounted ring, and said toothed sections are disposed thereon, and wherein a first tooth of the toothed section meshable with said toothed segment of said stop shaft, and a last tooth of the toothed section meshable with said toothed segment of said catching-arm shaft are offset in circumferential direction of said ring with respect to one another by a given angle, due to which said first tooth engages said toothed segment of said stop shaft only when said toothed segment of said catching-arm shaft has released said last tooth.

5. Delivery according to claim 3, wherein said drive means comprise a ring rotatably mounted in a frame of the printing press, and said two toothed sections are formed on the inside of said ring.

6. Delivery according to claim 1, wherein said stop shaft and said catching-arm shaft are closely juxtaposed at substantially the same height and parallel to one another.

7. Delivery according to claim 3, wherein said toothed segments, respectively on said stop shaft and on said catching-arm shaft, and said ring with said two toothed sections formed on the inside thereof are disposed on each of the two sides of the printing press.

8. Delivery according to claim 7, wherein both of said toothed segments and said respective toothed sections have slightly overlapping angles of mesh, so that at least one tooth-flank contact is maintained in each of the toothed segments of each of the pairs of meshing toothed sections and toothed segments.

9. Delivery according to claim 8, wherein the teeth of said toothed segment on said catching-arm shaft are in meshing engagement with the appertaining toothed section of said ring, when said catching arm is in a rest position, and the teeth of said toothed segment on said stop shaft are in engagement with the appertaining toothed section of said ring, when said stops are in a retracted position.

10. Delivery according to claim 9, including respective end-position springs anchored to a frame of the printing press and connected to said stop shaft and said catching-arm shaft, said end-position springs being arranged so as to attain a maximum tensioning force on a swiveling path of the respective shaft connected thereto from one end position to another end position thereof.

11. Delivery according to claim 1, wherein said drive means comprise a rotatable ring, and said complementary, mating connecting members on said ring are formed as sliding-block guides open at one side thereof, and said complementary, mating connecting members of said catching-arm shaft and said stop shaft are formed as respective pins fixedly connected to respective levers attached to said catching-arm shaft and said stop shaft.

12. Delivery according to claim 1, wherein said drive means comprise a rotatable ring carrying a sliding-block guide, and a linearly movably-guided member engaging in said sliding-block guide for converting linear motion of said member into rotational motion of said ring.

* * * * *